United States Patent [19]

Johnson

[11] 4,001,920

[45] Jan. 11, 1977

[54] QUICK-DISCONNECT BUCKLE

[76] Inventor: Edwin L. Johnson, N. 166 W. 20832 Parkway Drive, Jackson, Wis. 53037

[22] Filed: July 31, 1975

[21] Appl. No.: 600,263

[52] U.S. Cl. ..... 24/75; 24/68 CD

[51] Int. Cl.[2] ..... A44B 21/00

[58] Field of Search ..... 24/75, 68 R, 68 D, 68 E, 24/68 CD, 265 CD, 271, 193, 194, 196, 197

[56] References Cited

UNITED STATES PATENTS

| | | | |
|---|---|---|---|
| 2,743,497 | 5/1956 | Davis | 24/196 |
| 2,825,109 | 3/1958 | Nelson | 24/68 D |
| 2,835,015 | 5/1958 | Emmins | 24/271 |
| 3,441,987 | 5/1969 | Cregier | 24/271 |
| 3,641,630 | 2/1972 | Farley | 24/68 CD |
| 3,703,024 | 11/1972 | Johnson | 24/68 CD |
| 3,887,966 | 6/1975 | Gley | 24/68 CD |

FOREIGN PATENTS OR APPLICATIONS

| | | | |
|---|---|---|---|
| 2,003,030 | 7/1971 | Germany | 24/193 |

*Primary Examiner*—Donald A. Griffin
*Attorney, Agent, or Firm*—Michael, Best & Friedrich

[57] ABSTRACT

A quick-disconnect buckle for engaging and tightening the ends of a strap, the buckle having a channel-shaped frame member with upwardly extended flanges fixed to one end of the strap, the flanges having downwardly extending slots with narrow apertures. A channel-shaped handle member is adjustably secured to the other end of the strap and has downwardly extending flanges with transversely extending pins. The pins, having non-circular cross sections, are detachably pivotally engaged within the slots when the handle member is in an open position and are fixedly pivotally engaged within the slot when the handle member tightens the strap by pivoting from an open to an over-the-center closed position.

7 Claims, 7 Drawing Figures

Fig. 2

QUICK-DISCONNECT BUCKLE

BACKGROUND OF THE INVENTION

The field of invention pertains to buckles which are used in tightening straps. Buckles and straps of this general type are often used for securing motorcycles, snowmobiles, boats and other loads on trailers, as well as in similar tie-down applications.

Prior commercial buckles of this general type are disclosed in U.S. Pat. No. 2,825,109 and U.S. Pat. No. 3,703,024, both of which are predecessors to the buckle embodying the present invention.

SUMMARY OF THE INVENTION

The present invention utilizes a frame member which is fixed to one end of the strap and a pivoted handle member which is adjustably fixed to the other end of the strap and which, upon being pivoted within the frame member from an open to a closed position, tightens the strap and moves into an over-the-center position to thus cause the tightened strap to exert a closing force on the handle member. The handle member is provided intermediate its length with transversely extending pins which are captured in slots provided in upwardly extending flanges of the frame member. When the handle is in the open position, the pins are in a position in which they can escape from the slots to thus permit the handle member to be quickly disconnected from the frame member. When the handle member is pivoted from the open to the closed position, the pins are rotated to a position in which they cannot escape from the slot and, in the completion of the pivotal closing movement of the handle member, it moves past two inwardly projecting nibs which are provided on the inside of the frame member flanges. The nibs prevent accidental or unintentional opening of the buckle.

DESCRIPTION OF THE PREFERRED EMBODIMENT

Figure 1:
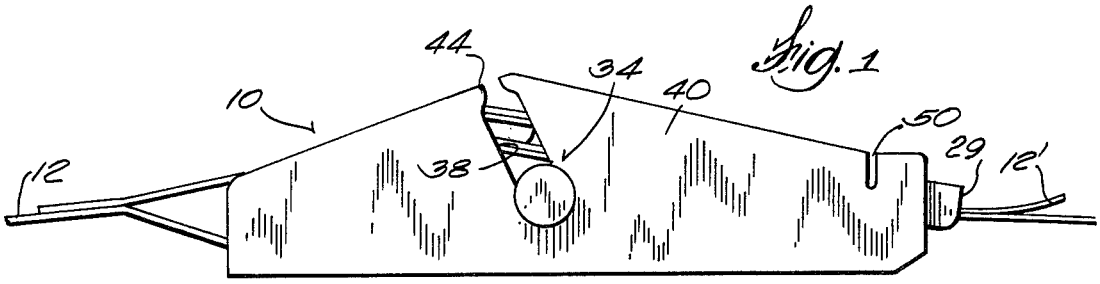
FIG. 1 is a side view of the buckle embodying the present invention, with the handle member being shown in the closed position.
Figure 2:
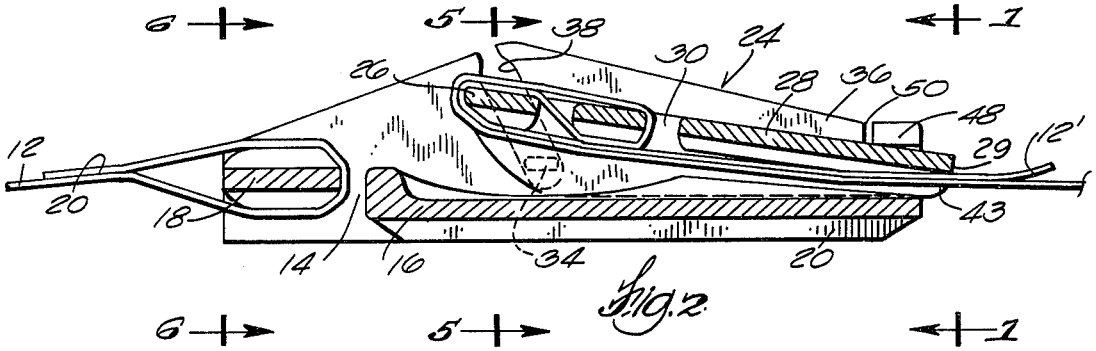
FIG. 2 is a cross-sectional side view of the buckle shown in FIG. 1.
Figure 3:
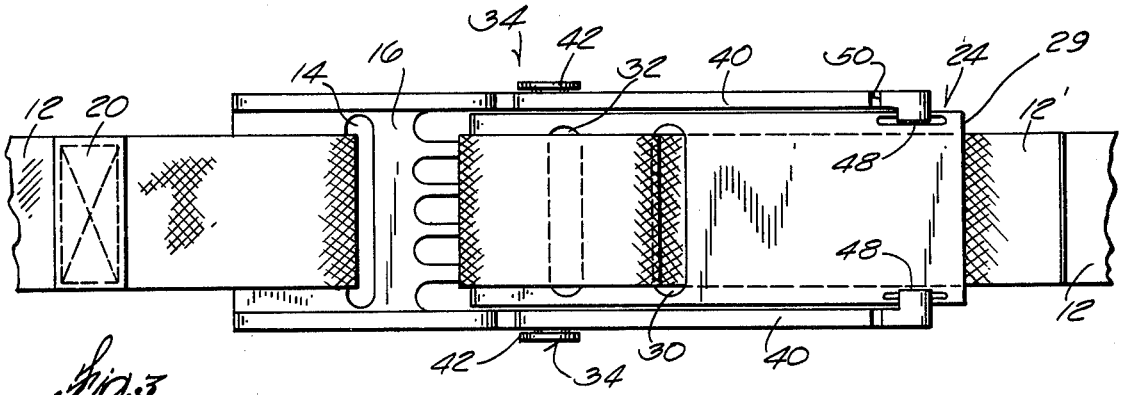
FIG. 3 is a top view of the buckle shown in FIG. 1.
Figure 6:
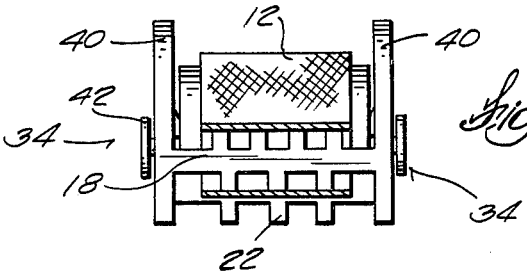
FIG. 6 is an end view of the buckle taken on line 6—6 of FIG. 2.

The buckle embodying the present invention has a channel-shaped frame member 10 which is fixed to one end of a flexible strap 12. As best illustrated in FIGS. 2 and 3, the end of the strap is threaded through slot 14, provided in the bottom web 16 of the frame member, then is looped around cross member 18 and then is fixed to itself at 20 by a joining plate (not shown) or other suitable means to thus provide a secure loop. Longitudinal nibs 22 and 22' extend on both sides of the bottom web 16 to provide strength and rigidity to the frame member.

Figure 4:
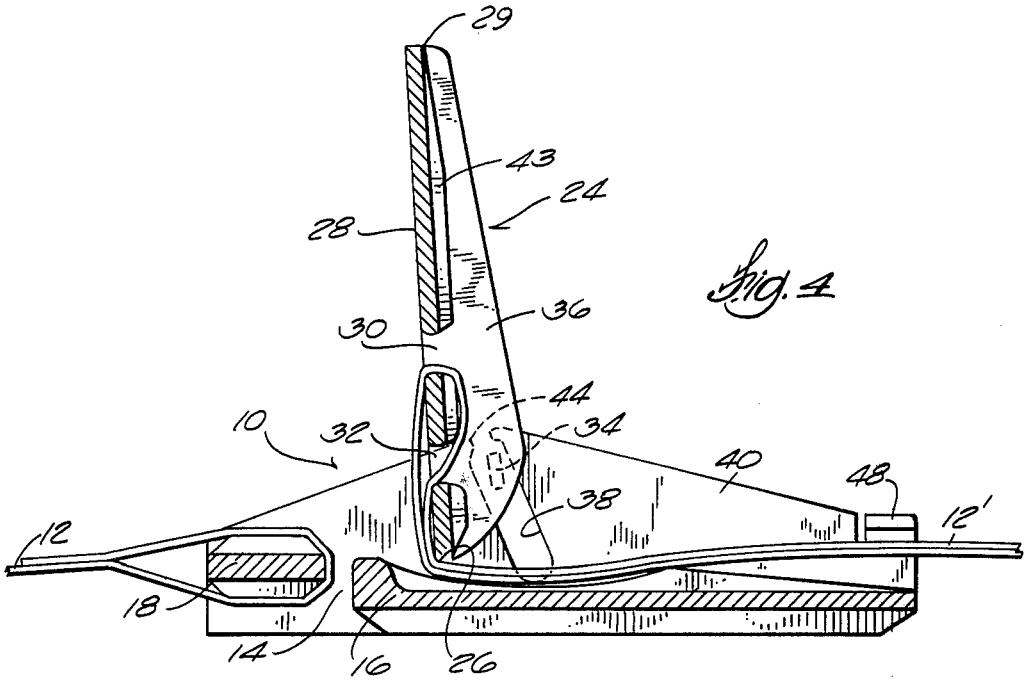
FIG. 4 is a cross-sectional side view of the buckle with the handle member being shown in the open position.
Figure 5:
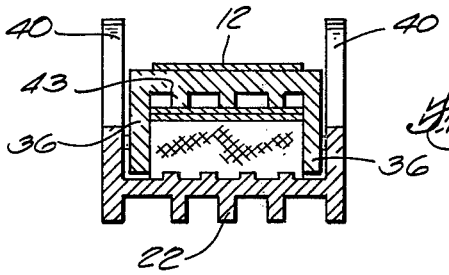
FIG. 5 is a cross-sectional view taken on line 5—5 of FIG. 2.
Figure 7:
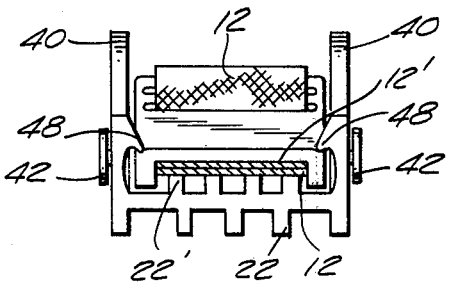
FIG. 7 is an end view of the buckle taken on line 7—7 of FIG. 2.

The other end of the strap 12 is adjustably fixed to a channel-shaped handle member 24. As best illustrated in FIGS. 2 and 4, the other end of the strap 12 is first looped upwardly over the front edge 26 of the top web 28 of the handle member, then is threaded downwardly through a transversely extending slot 30, then upwardly through a similar slot 32, and then is threaded back over the edge 26. The free or non-load-bearing end 12' of the strip thus extends backwardly from the buckle and lies on top of the trailing load-bearing portion of the strip.

Transversely extending pins 34, which are provided on each flange 36 of the handle member, project through downwardly and backwardly extending retaining slots 38 which are provided in each of the flanges 40 of the frame member. The handle member 24 includes an end portion 29, and in the preferred embodiment shown, the transversely extending pins 34 are laterally positioned intermediate the length of the handle member 24 between the front edge 26 and the end portion 29. Those portions of the pins which project through the slots have a non-circular cross-section which is the center segment of the circle and thus, in cross-section each of the pins has a long axis which is equal to the diameter of the circle and a short axis which is equal to the width of the segment. As illustrated, the long axis is generally parallel to the web of the handle member and the short axis is transverse thereto. The shape of the pins may be produced by milling off equal segments from a round pin, or, if the entire handle member is cast, the pins may be cast with the cross-sectionally elliptical contour. A button or outwardly extending flange 42 is provided at the end of each pin and prevents substantial transverse movement of the handle member in respect to the frame member. Longitudinal nibs 43 are provided on the bottom face of the handle member and give it rigidity and strength.

Each of the retaining slots 38 has a narrow aperture 44 which is only slightly larger than the short axis of the pins 34 and which is smaller than the long axis of the pins. Because of this feature, the handle member can be disengaged from the frame member when the handle member 28 is rotated to an open position, in which the long axis of the pins are generally aligned with the center line of the retaining slots 38; however, the pins and thus the handle member cannot escape from the slots if the handle member is pivoted away from the open position.

The novelty of the buckle is apparent from its operation. In securing a load to a platform or in a similar application, the strap 12 is first threaded through slots 30 and 32 of the handle member at a time when the handle member is disengaged from the frame member. By pulling the free end 12' of the strap, the tightness of the strap is adjusted to a point where the strap is fairly tight when the pins 34 are aligned with the openings of the retaining slots 38. Then the pins 34 are inserted within the slots 38 and the handle brought to its open position as shown in FIG. 4. If need be, at this time the strap can be further tightened by pulling on its free end 12'. Then the end portion 29 of the handle member is pivoted and pressed downwardly. During this motion, the pins 34 simultaneously rotate and move downwardly within the retaining slot 38 and the front edge 26 of the handle member moves forwardly (towards the fixed end of strap 12), thereby exerting a tightening force on the strap. The strap is brought to its tightest state when the handle has been pivoted and depressed to a point in which the pins 34 have reached the bottom of slots 38. Further, depression of the end portion 29 of the handle member causes the member to rotate around the axis of pins 34 while the pins are at the bottom of slots 38. Such further motion causes the edge 26 and the trailing load-bearing portion of the strap to move upwardly to an over-the-center position in respect to the axis of pins 34, i.e. the strap section on which a closing force is exerted is moved to a plane above the axis of pins 34 and thus the strap exerts a closing force on the handle member. It should be readily understood from the drawings and the above described inherent operation of the buckle, that as the handle member 24 pivots about the transversely extending pins 34, it operates as a lever. The leverage or mechanical advantage which is produced to assist in tightening the strap 12 when the forward edge 26 is pivoted forwardly and upwardly is dependent on and generally equal to the ratio of the respective lateral distances between the end portion 29 and the pin 34, and between the front edge 26 and the pin 34. As is clearly shown in the drawings, preferably the pins 34 are laterally positioned closer to the front edge 26 than to the end portion 29 so that the mechanical advantage or ratio of the respective lateral distances is greater than one. During the entire pivotal movement of the handle member, when the trailing load-bearing portion of the strap is put under tension, the frictional resistance of the overlapping strap portions to relative movement at the front edge 26 of the handle member is sufficiently great to prevent any slippage of the strap.

Inwardly projecting nibs 48 are provided on the inside faces of the flanges 40 of the frame member. The nibs project into the path of the handle member, and, as the latter is moved into its closed position, the nibs are pressed outwardly and then moved back to overlap and positively engage the top face of the handle member. This feature provides a positive lock for the handle member. The movement of the nibs is facilitated by the flexibility of the frame member material as well as by slits 50 which are provided in each flange of the member. The nibs prevent inadvertent openings of the buckle as might be the case if the loose end 12' of the strap were to be pulled upwardly. Thus, before the buckle is opened, the nibs have to be pressed outwardly to permit the handle member to be pivoted from the closed to the open position.

I claim:

1. A quick-disconnect buckle for engaging and tightening the ends of a strap, said buckle comprising:

a. a frame member secured to one end of the strap, having upwardly extending flanges with transverse retaining slots with narrow apertures extending downwardly and away from the fixed end of the strap, b. a handle member adjustably secured to the other end of the strap, said handle member having a front edge and an end portion, and having downwardly extended flanges, and c. transversely extending pins having non-circular cross-sections secured to said handle member flanges, and laterally positioned between said front edge and said end portion, said pins being detachably, pivotally engaged within said retaining slots when said handle member is in an open position, and said pins being fixedly pivotally engaged within said retaining slots when said handle member pivots from an open to closed position, said end portion pivoting downwardly and said front edge pivoting forwardly and upwardly, thereby tightening the strap as said handle member pivots from an open to closed position.

2. A quick-disconnect buckle for engaging and tightening the ends of a strap, said buckle comprising:

a. a channel-shaped frame member having a bottom web secured to upwardly extending flanges, said bottom web having one end of the strap to be tightened fixedly secured at one end, said upwardly extending flanges having intermediate their lengths transverse retaining slots with narrow apertures, said retaining slots extending downwardly and away from said fixed end of the strap, b. a channel-shaped handle member having an end portion, and having a top web secured to downwardly extending flanges, said top web having a front edge and means for adjustably securing a free end and trailing portion of the strap to be tightened adjacent said front edge, said securing means preventing movement of the trailing portion of the strap with respect to the handle member when said trailing portion is put under tension, and c. transversely extending pins having non-circular cross-sections secured to the handle member flanges, and positioned between said front edge and said end portion, said pins being laterally positioned closer to said front edge than to said end portion, said pins being detachably pivotally engaged within said retaining slots when said handle member is in an open position, and said pins being fixedly pivotally engaged within said retaining slots when said handle member pivots from an open to an over-the-center closed position, said end portion pivoting downwardly and said front edge pivoting forwardly and upwardly, thereby tightening the strap as said handle member pivots from an open to an over-the-center closed position.

3. A quick-disconnect buckle, as specified in claim 2 wherein:

a. said bottom web has a cross member adjacent a slot at one end, the fixed end of the strap to be tightened passing through said slot, looping around said cross member and being fixed to itself, and b. said top web securing means comprises said top web having inwardly spaced transversely extending first and second slots, the free end of the strap to be tightened, being looped upwardly over the front edge and threaded downwardly through the second slot, thence upwardly through the first slot and downwardly over the front edge, the leading free end of the strap being adjacent and inside of the trailing portion of the strap.

4. A quick-disconnect buckle for engaging and tightening the ends of a strap, said buckle comprising:

a. a channel-shaped frame member having a bottom web secured to upwardly extending flanges, said bottom web having a cross member adjacent a slot at one end, the fixed end of the strap to be tightened passing through said slot, looping around said cross member and being fixed to itself, said upwardly extending flanges having intermediate their lengths transverse retaining slots with narrow apertures, said retaining slots extending downwardly and away from said cross member, b. a channel-shaped handle member having a top web secured to downwardly extending flanges, one end of said top web having a front edge and inwardly spaced transversely extending first and second slots, the free end of the strap to be tightened being looped upwardly over the front edge and threaded downwardly through the second slot, thence upwardly through the first slot and downwardly over the front edge, the leading free end portion of the strap being adjacent and inside of a trailing portion of the strap, said adjacent overlapping strap portions providing frictional resistance preventing relative movement when the trailing portion of the strap is put under tension, and c. outwardly extending pins secured to the handle member flanges, said pins extending laterally through the retaining slots of the frame member flanges, said pins having a cross section with a short axis generally perpendicular to the web of the handle member, and with a long axis generally parallel to the web of the handle member, the short axis width of the pin just being able to slide through the narrow aperture of the retaining slot when the handle member is in an open position above and generally perpendicular to the bottom web of the frame member, the long axis width of the pin not being able to slide through and out of the narrow aperture of the retaining slot when the handle member is in a closed position relatively parallel to the bottom web of the frame member, said handle member pivoting about said pins from an open to an over-the-center closed position, said front edge of the top web being pivoted toward the fixed end of the strap so that overlapping portions of the strap are tightened.

5. A quick-disconnect buckle, as specified in claim 4 wherein:

a. said upwardly extending flanges have inwardly projecting nibs adjacent slits at the end opposite the cross member, and b. said handle member pivoting about said pins from an open to an over-the-center closed position, is forced past said inwardly projecting nibs of the frame member, said nibs locking the handle member within the frame member of the buckle.

6. A quick-disconnect buckle, as specified in claim 4 wherein:

a. said transversely extending pins extending laterally through the retaining slots of the frame member flanges have outwardly extending flanges at their outer ends to prevent substantial transverse movement of the handle member with respect to the frame member.

7. A quick-disconnect buckle for engaging and tightening the ends of a strap, said buckle comprising:

a. a channel-shaped frame member having a bottom web secured to upwardly extending flanges, said bottom web having a cross member adjacent a slot at one end, the fixed end of the strap to be tightened passing through said slot, looping around said cross member and being fixed to itself, said upwardly extending flanges having intermediate their lengths transverse retaining slots with narrow apertures, said retaining slots extending downwardly and away from said fixed end of the strap, b. a channel-shaped handle member having a top web secured to downwardly extending flanges, said top web having a front edge and inwardly spaced transversely extending first and second slots, the free end of the strap to be tightened, being looped upwardly over the front edge and threaded downwardly through the second slot, thence upwardly through the first slot and downwardly over the front edge, the leading free end of the strap being adjacent and inside of the trailing portion of the strap so that movement of the trailing portion of the strap with respect to the handle member is prevented when said trailing portion is put under tension, and c. transversely extending pins having non-circular cross-sections secured to the handle member flanges, said pins being detachably pivotally engaged within said retaining slots when said handle member is in an open position, and said pins being fixedly pivotally engaged within said retaining slots when said handle member tightens the strap by pivoting from an open to an over-the-center closed position.

* * * * *